US006186066B1

(12) United States Patent
Kim

(10) Patent No.: US 6,186,066 B1
(45) Date of Patent: Feb. 13, 2001

(54) ROLLER CLEANING APPARATUS FOR LIQUID PRINTER

(75) Inventor: Kyung-Hwan Kim, Yongin (KR)

(73) Assignee: Samsung Electronics Co, Ltd., Suwon (KR)

( * ) Notice: Under 35 U.S.C. 154(b), the term of this patent shall be extended for 0 days.

(21) Appl. No.: 09/273,763

(22) Filed: Mar. 22, 1999

(30) Foreign Application Priority Data

Mar. 20, 1998 (KR) ..... 98-9706

(51) Int. Cl.[7] ..... B41F 35/00

(52) U.S. Cl. ..... 101/423; 101/425; 399/101; 399/297

(58) Field of Search ..... 101/423, 424, 101/425, 487; 15/256.51, 256.52, 256.5; 399/101, 297, 302, 308

(56) References Cited

U.S. PATENT DOCUMENTS 3,861,860 * 1/1975 Thettu et al. ..... 432/59
3,921,573 * 11/1975 Thettu ..... 118/70
4,579,802 * 4/1986 Kishi et al. ..... 430/99
4,607,947 * 8/1986 Ensing et al. ..... 355/15
5,619,314 * 4/1997 Kubo ..... 399/296
5,768,672 * 6/1998 Van Herpen et al. ..... 399/327
5,805,963 * 9/1998 Teschendorf et al. ..... 399/249
5,850,588 * 6/1998 Yoshikawa ..... 399/327
5,930,574 * 7/1999 Segawa ..... 399/327
5,953,573 * 9/1999 Eum ..... 399/308
5,970,281 * 10/1999 Park ..... 399/101

* cited by examiner

*Primary Examiner*—John S. Hilten
*Assistant Examiner*—Anthony H. Nguyen
(74) *Attorney, Agent, or Firm*—Robert E. Bushnell, Esq.

(57) ABSTRACT

An apparatus for cleaning a roller for a liquid printer includes a first cleaning unit and second cleaning unit. Foreign materials adhering on the transfer roller are removed from the surface of the transfer roller and transferred to the cleaning roller of the first cleaning unit. A cleaning web of the second cleaning unit is used for removing foreign materials from the surface of the cleaning roller of the first cleaning unit. The surface of the transfer roller is prevented from contamination. Also, the transfer roller can transfer clear images to the paper.

20 Claims, 3 Drawing Sheets

ROLLER CLEANING APPARATUS FOR LIQUID PRINTER

CLAIM OF PRIORITY

This application makes reference to, incorporates the same herein, and claims all benefits accruing under 35 U.S.C. §119 from an application for CLEANING APPARATUS FOR LIQUID PRINTER earlier filed in the Korean Industrial Property Office on Mar. 20, 1998 and there duly assigned Ser. No. 98-9706.

BACKGROUND OF THE INVENTION

1. Field of the Invention

The present invention generally relates to an apparatus for cleaning a roller for a liquid printer. More particularly, it relates to an apparatus for removing foreign materials adhering on the surface of a roller.

2. Description of the Related Art

Transfer rollers transferring a transferrable image of a filmed toner to a paper have been widely used in a liquid printer. Typically, several rollers are used in a liquid printer for transferring the image to the paper. A predetermined electrostatic latent image is formed on a photoreceptor belt moving around guide rollers. A developer, a mixture of toners and a liquid carrier, is developed on the area of the electrostatic latent image of the photoreceptor belt. After a filmed toner is formed, the remaining liquid carrier is removed by a dry roller, and the filmed toner on the photoreceptor belt is transferred to a paper through the transfer roller.

However, the drying roller and the transfer roller may be getting contaminated by foreign materials such as dirt and debris after several hours of printing cycles. Also the transfer roller and drying roller are contaminated by contacting the photoreceptor belt. Thus the filmed toner on the photoreceptor belt can be damaged by the contaminated drying roller and transfer roller. Moreover, a ghost effect may be generated, and a clear image cannot be printed on the paper. Therefore I have found that the transfer roller and the drying roller should be kept clean and that the liquid printers require a cleaning apparatus for cleaning a drying roller or a transfer roller in order to transfer a clear image to the paper.

SUMMARY OF THE INVENTION

It is an object of the present invention to provide an improved printer for printing a clear image.

It is another object to provide an improved printer preventing a printing image from deteriorating.

It is yet another object to provide an cleaning apparatus preventing a transfer roller or a drying roller from being damaged.

It is still another object to provide an cleaning apparatus removing foreign materials from a transfer roller and a drying roller.

It is still yet another object to provide an cleaning apparatus preventing a transfer and drying rollers from being contaminated.

It is further object to provide a cleaning apparatus for keeping a transfer and drying rollers clean after several hours of repeated printing cycles.

It is also object to provide a cleaning apparatus for allowing a transfer roller to transfer a clear transferrable image of a filmed toner to a paper.

These and other objects may be achieved by attaching a cleaning apparatus to a transfer roller or a drying roller. The cleaning apparatus for cleaning the transfer roller includes a first cleaning unit having a cleaning roller contacting the transfer roller, being rotated by the rotation of the transfer roller, disposing between an outlet of a printed paper and a photoreceptor belt, contacting a surface of transfer roller of which the other surface bears a transferable image, and removing foreign materials by using a different surface energy between the surfaces of the transfer roller and the cleaning roller. Also the cleaning apparatus includes a second cleaning unit having a cleaning web removing the transferred foreign materials adhered to the surface of the cleaning roller from the surface of the cleaning roller. The cleaning web is withdrawn from a supply reel and is wound on a take up reel. A support roller pushes the cleaning web against the cleaning roller and is contacting and disengaging the cleaning roller through the cleaning web. The cleaning roller may be contacting and disengaging the transfer roller. The cleaning apparatus can be attached to a drying roller unit. The cleaning roller is contacting the drying roller and a heater is provided into the inside of the cleaning roller.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
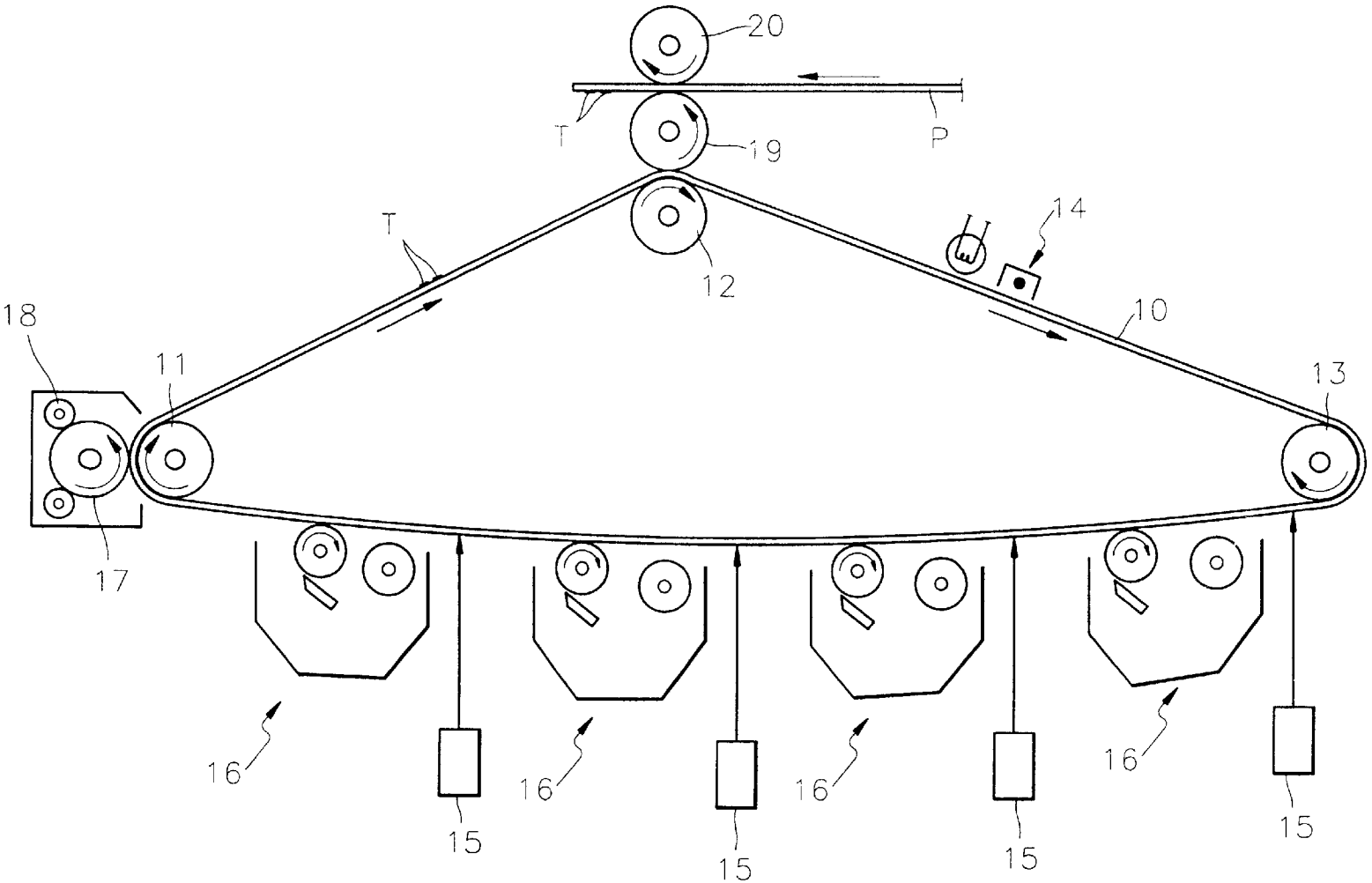
FIG. 1 (PRIOR ART)
FIG. 1 is a cross sectional view showing a configuration of a liquid printer.

FIG. 1 is a cross sectional view showing a configuration of a liquid printer. A liquid printer such as a laser printer includes a photoreceptor belt 10 continuously circulating and being supported by a plurality of guide rollers 11, 12 and 13. Also the liquid printer includes a plurality of developing units 16, a drying unit having a drying roller 17, and a transfer unit having a transfer roller 19.

The surface of photoreceptor belt 10 is charged to a predetermined electric potential by a charger 14. The electric potential of the surface of photoreceptor belt 10 is varied by light scanned by a laser scanning unit 15 which is installed close to the respective developing units 16 so that a predetermined electrostatic latent image is formed on the surface of photoreceptor belt 10.

The developing units 16 develop a developer, which is a mixture of toner T and a liquid carrier, on the area of the electrostatic latent image of photoreceptor belt 10. The toner T is made to be filmy. After a filmed toner is formed, the remaining developer is removed from the photoreceptor belt 10. A small quantity of the liquid carrier remaining on the photoreceptor belt 10 is removed in the drying unit including drying roller 17. The liquid carrier transferred to the drying roller 17 is heated and vaporized by a plurality of heating rollers 18 rotating in contact with the drying roller 17. The filmed toner T on the photoreceptor belt 10 is transferred to the transfer roller 19 by difference of the surface energy between the photoreceptor belt 10 and the transfer roller, and then an image of the filmed toner is printed on a paper P which passes between the transfer roller 19 and a fusing roller 20.

However, the drying roller 17 and the transfer roller 19 may be contaminated by foreign materials such as debris and dirt after several hours of printing cycle. When the rollers 17 and 19 contacting the photoreceptor belt 10 are contaminated by materials being detached from the photoreceptor belt 10, the filmed toner T can be damaged by the contaminated drying roller 17. A ghost effect may be generated and transferred to the paper P during printing cycle.

Figure 2:
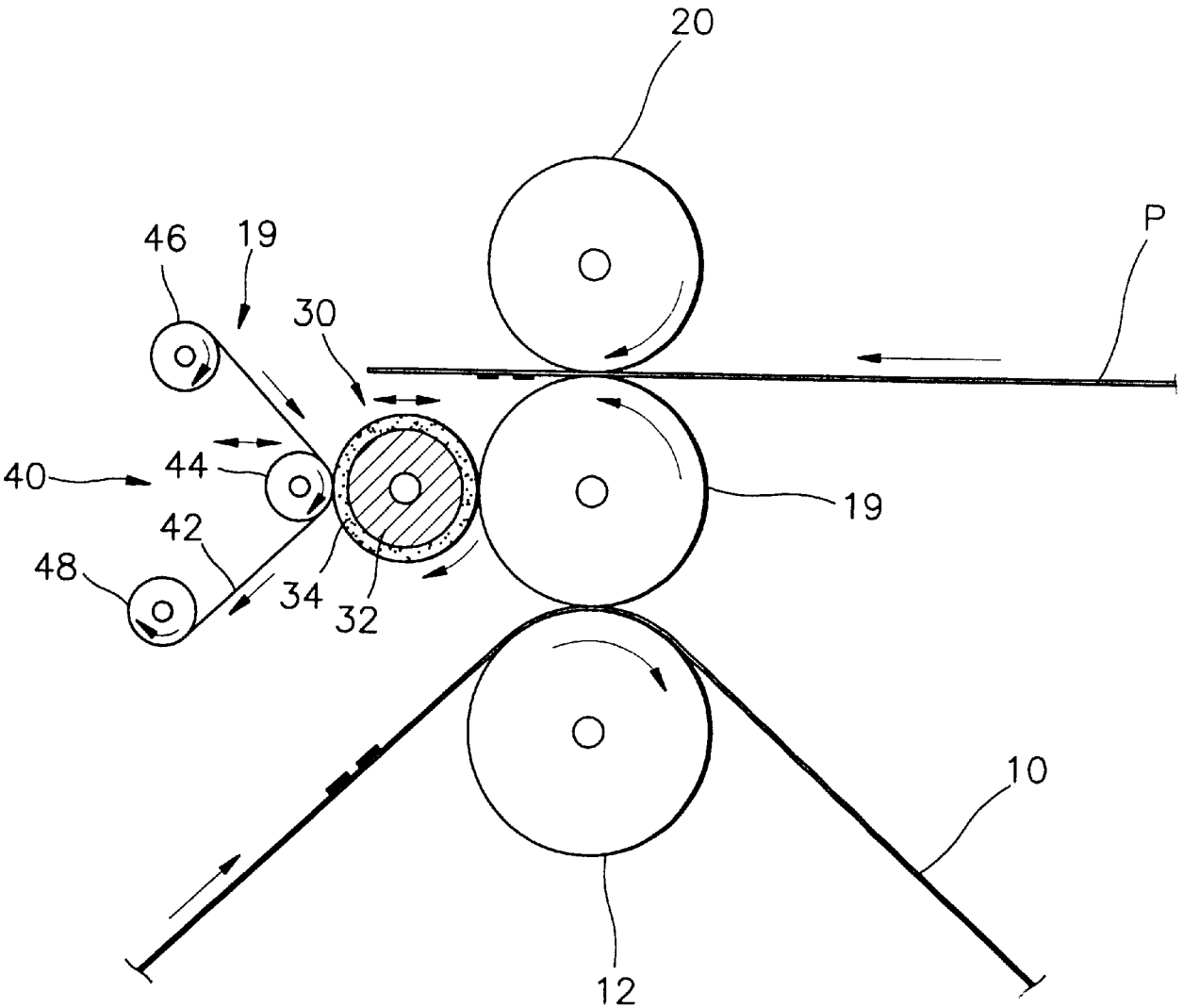
FIG. 2 is a cross sectional view showing a cleaning apparatus attached to the transfer roller according to the practice of the present invention.

FIG. 2 is a cross sectional view showing a cleaning apparatus attached to the transfer roller according to the practice of the present invention. The cleaning apparatus includes a first cleaning unit having a cleaning roller 30 for removing foreign materials on the transfer roller 19 and a second cleaning unit 40 for cleaning foreign materials adhering to the cleaning roller 30.

Cleaning roller 30 is selectively contacting and disengaging the transfer roller 19 by a driving source (not shown). When the cleaning roller 30 contacts the transfer roller 19, the cleaning roller 30 is rotated by the rotation of transfer roller 19 and cleans the surface of the transfer roller 19 containing the foreign materials. The transfer roller has a surface contacting the cleaning roller and the other surface bearing a transferrable image and transferring the transferrable image to the paper.

The cleaning roller 30 has a support layer 32 formed of a metallic material and an absorbing layer 34 coated on the outer circumference of support layer 32. The absorbing layer 34 has a surface energy higher than that of the transfer roller 19, preferably, above 25 dyne/cm and below 100 dyne/cm. For a material having the above surface energy, a kind of nylon such as acetal, polymethyl methacrylate (PMMA), nylon-6 or nylon-12 can be used. Accordingly, foreign materials existing on the surface of transfer roller 19 having a surface energy of below 25 dyne/cm can be transferred to the absorbing layer 32 by the difference between the surface energies. An upper limit of the surface energy of 100 dyne/cm may be set because foreign materials are not easily transferred to the second cleaning means 40 when the surface energy of the absorbing layer 34 is too great. The cleaning roller 30 is disposed to face the printed paper P coming out between the transfer roller 19 and the fusing roller 20 in order not to affect the printing cycle.

The second cleaning unit 40 includes a cleaning web 42 for removing foreign materials adhering to the cleaning roller 30, a supply reel 46, a take up reel 48, and a support roller 44. The cleaning web 42 withdrawn from the supply reel 46 is wound around the take up reel 48. The support roller 44 pushes the cleaning web against the cleaning roller to contact the cleaning roller 30 so that foreign materials transferred from the transfer roller 19 to the cleaning roller 30 can be cleaned away from the cleaning roller 30. In consideration of friction heat between the cleaning web and the cleaning roller 30, the cleaning web 42 is preferably made of a polyester fiber material or a non-woven fabric having a heat resistance property.

The support roller 44 is contacting and disengaging the cleaning roller 30 through the cleaning web while the cleaning web 42 is disposed between the support roller 44 and the cleaning roller 30. The support roller 44 makes the cleaning web 42 closely contact the cleaning roller 30 and guides the cleaning web 42 to be fed. Also, the supply reel 46, the take up reel 48, and the support roller 44 are integrally formed in the form of a cartridge and installed to contact and disengage the cleaning roller 30.

When a printing cycle repeats for several hours, the transfer roller 19 becomes to be contaminated by foreign materials, and the cleaning roller 30 being away from the transfer roller 19 is driven to contact the transfer roller 19. Then, the cleaning roller 30 is passively rotated by a frictional force of the transfer roller 19. The foreign materials adhering to the surface of the transfer roller 19 are transferred to the absorbing layer 34 of the cleaning roller 30 by a difference of the surface energy between the transfer roller 19 and the cleaning roller 30. The cleaning web 42 begins to be fed and contacts the cleaning roller 30, and the foreign materials transferred to the absorbing layer 34 are cleaned away by the cleaning web 42.

When the cleaning capability is lowered due to the amount of the foreign materials accumulated on the cleaning web 42, the take up reel 48 rotates to feed the cleaning web and to withdraw the cleaning web from the supply reel 46. The clean portion of the cleaning web 42 contacts the cleaning roller 30, and the cleaning web continues to clean the cleaning roller 30. By removing the foreign materials from the surface of the transfer roller 30 as above, the quality of an image printed on the paper P is prevented from deteriorating. The transfer roller 19 is cleaned after transferring an image to the paper P is completed. Also a cleaning operation and a printing operation are performed simultaneously.

Figure 3:
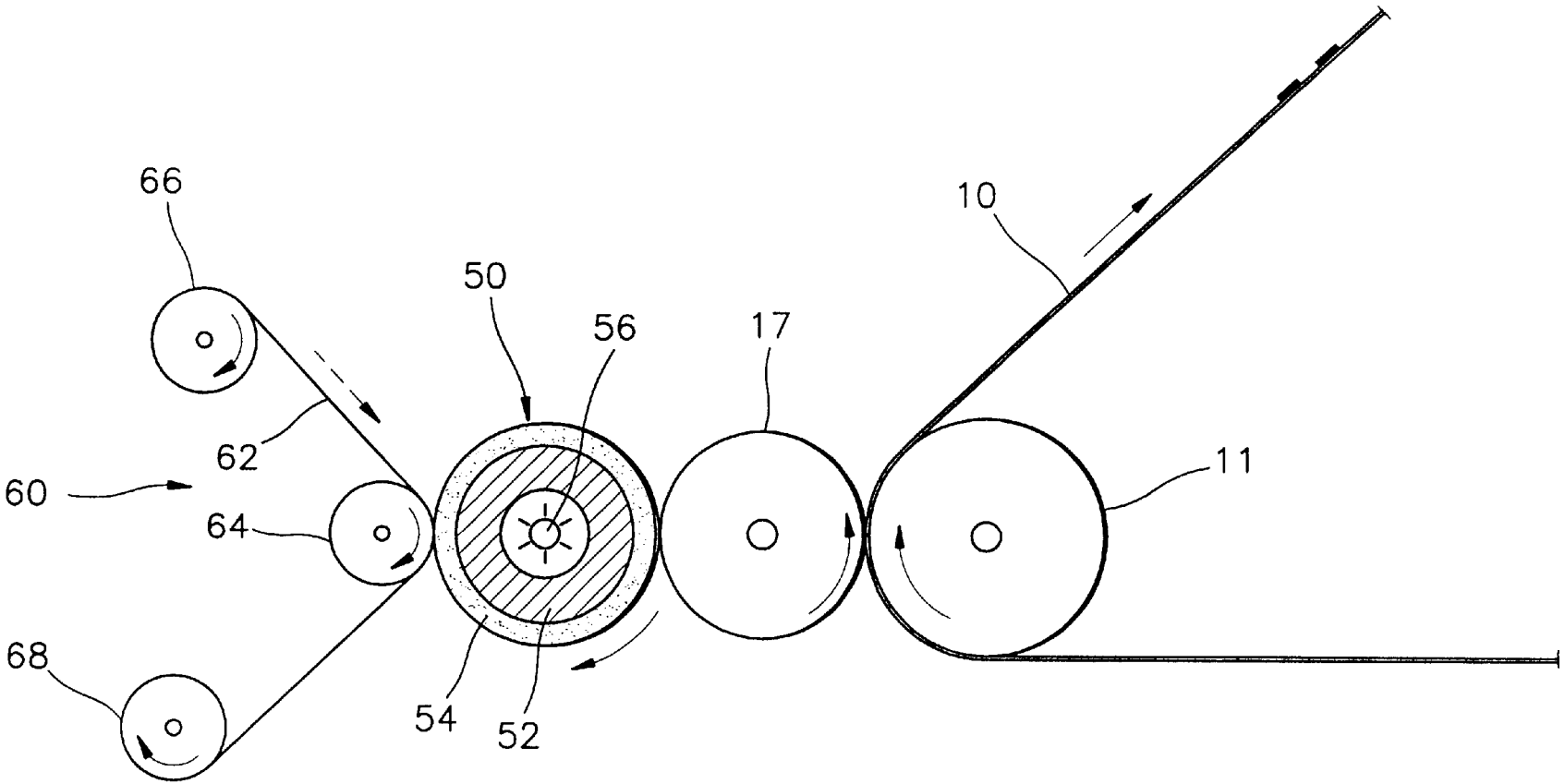
FIG. 3 is a cross sectional view showing a cleaning apparatus attached to the drying roller for a liquid printer according to another embodiment of the present invention.

FIG. 3 is a cross sectional view showing a cleaning apparatus attached to the dry roller for a liquid printer according to another embodiment of the present invention. The cleaning apparatus includes a third cleaning unit for cleaning foreign materials adhering to a surface of drying roller 17 and a fourth cleaning unit 60 for cleaning foreign materials adhering to a surface of the third cleaning unit.

The third cleaning unit includes a second cleaning roller 50 which rotates by a frictional force between the second cleaning roller 50 and the drying roller 17. The second cleaning roller 50 includes a support layer 52 formed of a metallic material, an absorbing layer 54 coated on the outer circumferential surface of the support layer 52, and a heater 56 installed inside of support layer 52. The absorbing layer 54 cleans a surface of the drying roller 17 containing the foreign materials by means of a difference of the surface energies during contacting the drying roller 17.

The absorbing layer 54 has a surface energy relatively higher than that of the drying roller 17, preferably, above 25 dyne/cm or below 100 dyne/cm. The drying roller 17 has a surface energy of below 25 dyne/cm like the transfer roller 18 shown in FIG. 2. Accordingly, the absorbing layer 54 can be formed of the same material as that of the absorbing layer 34 shown in FIG. 2.

The heater 56 heats to vaporize a liquid carrier transferred to the drying roller 17 from the photoreceptor belt 10. Since the second cleaning roller 50 is provided with the heater 56, the heating roller 18 shown in FIG. 1 is not needed to vaporize the liquid carrier existing on the surface of the drying roller 17. Thus, the cleaning operation and the heating operation can be performed simultaneously by a single cleaning roller 50.

The fourth cleaning unit 60 can be contacting and disengaging the second cleaning roller 50 and removes foreign materials from the surface of the second cleaning roller 50. The fourth cleaning unit 60 includes a cleaning web 62 for removing foreign materials from the surface of the second cleaning roller 50, a supply reel 66, a take up reel 68, and a support roller 64.

The cleaning web 62 is withdrawn from the supply reel 66 and wound around the take up reel 68. The cleaning web 62 can be contacting and disengaging the absorbing layer 54. Preferably, the cleaning web 62 is formed of a polyester fiber material or a non-woven fabric which has a characteristic of a heat resistance and is capable of enduring a heat generated by a friction between the absorbing layer 54 and the cleaning web 62.

The support roller 64 pushes the cleaning web 62 against the absorbing layer 54 of second cleaning roller 50 and allows the cleaning web 62 to closely contact the second cleaning roller 50. The support roller is passively rotated by the cleaning web 62 during cleaning operation. The support roller 64 is installed to be capable of moving a predetermined distance by a driving source (not shown) and to make the cleaning web 62 contact or disengage the second cleaning roller 50.

The operation of the roller cleaning apparatus of FIG. 3 is explained as follows. When printing cycles are repeated, the cleaning web 62 is disengaging the second cleaning roller 50, and the cleaning roller 50 is in contact with the drying roller 17. The liquid carrier remaining on the photoreceptor belt 10 is transferred to the drying roller 17. The liquid carrier transferred to the drying roller 17 is vaporized and removed by the heat generated by the heater 56. Concurrently, foreign materials on the surface of the drying roller 17 are removed by being transferred to the absorbing layer 54 of the second cleaning roller 50 due to a difference of the surface energies. When a large amount of foreign materials accumulate on the absorbing layer 54, the cleaning web 62 contacts the cleaning roller 50 by moving the support roller 64 toward the absorbing layer 54. Then, the foreign materials on the surface of the absorbing layer 54 are removed and transferred to the cleaning web 62 due to a difference of the surface energies. When the cleaning capacity is lowered due to the amount of foreign materials accumulated on the cleaning web 62, the take up reel 68 rotates, a clean portion of the cleaning web 62 contacts the second cleaning roller 50, and the cleaning operation continues.

As a result, as the second cleaning roller 50 having a higher surface energy than that of the drying roller 17 contacts the outer circumferential surface of the second cleaning roller 50, foreign materials on a surface of the drying roller 17 can be easily removed and transferred. The foreign materials transferred to the second cleaning roller 50 are transferred to the cleaning web 62. The second cleaning roller 50 will be cleaned by the cleaning web 62. Therefore, contamination of the drying roller 17 can be effectively avoided.

As described above, the roller cleaning apparatus for a liquid printer according to the present invention prevents the each rollers from contamination by using the difference of surface energies of rollers. Moreover, the surface of the cleaning roller can be prevented from contamination of foreign materials by the cleaning web. Furthermore, a cleaning effect of the transfer roller or drying roller can be improved.

It is noted that the present invention is not limited to the preferred embodiment described above, and it is apparent that variations and modifications by those skilled in the art can be effected within the spirit and scope of the present invention defined in the appended claims.

What is claimed is:

1. An apparatus in a printers comprising:

a drying roller disposed to contact a photoreceptor belt bearing a transferrable image, liquid material, and foreign material, said foreign not material not forming part of said transferrable image, removing said liquid material and said foreign material not forming part of said transferrable image from the photoreceptor belt without removing said transferrable image from said photoreceptor belt;

a cleaning roller having a heater and an absorbing layer, contacting said during roller and vaporizing said liquid material attached to a surface of said drying rollers and transferring said foreign material attached to said surface of said drying roller to said absorbing layer of said cleaning roller; and a cleaning unit having a cleaning web contacting said cleaning roller and removing said foreign material from said absorbing layer of said cleaning roller by transferring said foreign material transferred from said absorbing layer of said cleaning roller to said cleaning web.

2. The apparatus of claim 1, with said cleaning roller comprising said heater disposed inside of said absorbing layer of said cleaning roller, heat from said heater being transferred to said surface of said drying roller through said absorbing layer and vaporizing said liquid material attached to said surface of said drying roller.

3. The apparatus of claim 1, with said cleaning roller comprising said absorbing layer formed on an outer surface of said cleaning roller, said heater installed on an inner side of said cleaning roller, and a support layer disposed between said absorbing layer and said heater.

4. The apparatus of claim 1, with said cleaning roller transferring said foreign material attached to said surface of said drying roller to said absorbing layer with a surface energy of said absorbing layer being higher than said surface of said drying roller.

5. The apparatus of claim 1, wherein said cleaning roller contacts said drying roller during a cleaning operation and disengages from said drying roller during a non-cleaning operation.

6. The apparatus of claim 1, wherein said absorbing layer of said cleaning roller is made of a material selected from the group consisting essentially of acetal, polymethyl methacrylate, and nylon.

7. The apparatus of claim 3, wherein said absorbing layer of said cleaning roller has a surface energy between 25 dyne/cm and 100 dyne/cm.

8. The apparatus of claim 1, with said cleaning unit comprising a supply reel supplying said cleaning web, a take up reel receiving said cleaning web supplied from said supply reel, and a rotatable support roller disposed between said supply reel and said take up reel to push said cleaning web against said cleaning roller.

9. The apparatus of claim 8, wherein said cleaning web is withdrawn from said supply reel, passes between said rotatable support roller and said cleaning roller, and is wound around said take up reel.

10. The apparatus of claim 1, with said cleaning unit comprising a rotatable support roller pushing said cleaning web against said cleaning roller and allowing said cleaning web to contact said cleaning roller and to transfer said foreign material attached to said absorbing layer of said cleaning roller to said cleaning web.

11. An apparatus in a printer, comprising:

a drying roller disposed to contact a photoreceptor belt carrying a transferrable image, liquid material, and foreign material, removing from said photoreceptor belt said liquid material and said foreign material without removing said transferrable image from said photoreceptor belt;

a cleaning roller having an absorbing layer disposed to contact a surface of said drying roller and a heater mounted inside of said cleaning roller, vaporizing said liquid material attached to said surface of said drying roller by using heat generated from said heater, and transferring said foreign material attached to said surface of said drying roller to said absorbing layer of said cleaning roller; and a cleaning unit having a cleaning web disposed to contact said absorbing layer of said cleaning roller, removing said foreign material from said absorbing layer of said cleaning roller and transferring said foreign material transferred from said absorbing layer of said cleaning roller to said cleaning web.

12. The apparatus of claim 11, with said cleaning roller comprising said absorbing layer having surface energy higher than said drying roller.

13. The apparatus of claim 12, further comprising said clearing layer transferring said heat generated in said heater is transferred to said surface of said drying roller through said absorbing layer and vaporizing said liquid material attached to said surface of said drying roller.

14. The apparatus of claim 11, with said cleaning roller comprising said absorbing layer forming an outer surface of said cleaning roller, said heater mounted inside of said absorbing layer of said cleaning roller, and a support layer disposed between said absorbing layer and said heater.

15. The apparatus of claim 14, with said absorbing layer of said cleaning roller contacting said surface of said drying roller without contacting said photoreceptor belt.

16. The apparatus of claim 11, wherein said liquid material attached to said surface of said drying roller is vaporized by heat generated from said heater of said cleaning roller while said foreign material attached to said surface of drying roller is transferred to said absorbing layer of said cleaning roller.

17. The apparatus of claim 11, wherein said cleaning roller contacts said drying roller in a cleaning operation and disengages from said drying roller in a non-cleaning operation.

18. The apparatus of claim 18, wherein said absorbing layer of said cleaning roller is made of a material selected from the group consisting of acetal, polymethyl methacrylate (PMMA), and nylons-based.

19. The apparatus of claim 18, wherein a surface energy of said absorbing layer is between 25 dyne/cm and 100 dyne/cm.

20. The apparatus of claim 11, with said cleaning unit comprising a support roller pressing said cleaning web against said cleaning roller and allowing said cleaning web to contact said cleaning roller and to transfer said foreign material attached to said absorbing layer of said cleaning roller to said cleaning web.

* * * * *